US009732462B2

(12) United States Patent
Kim et al.

(10) Patent No.: US 9,732,462 B2
(45) Date of Patent: Aug. 15, 2017

(54) STERILIZABLE DRYING MACHINE USING ULTRAVIOLET RADIATION AND STERILIZABLE DRYING METHOD IN THE SAME

(75) Inventors: Young-Soo Kim, Changwon-si (KR); Soung-Bong Choi, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 1788 days.

(21) Appl. No.: 12/094,086

(22) PCT Filed: Nov. 15, 2006

(86) PCT No.: PCT/KR2006/004819

§ 371 (c)(1), (2), (4) Date: Nov. 13, 2008

(87) PCT Pub. No.: WO2007/058479

PCT Pub. Date: May 24, 2007

(65) Prior Publication Data

US 2009/0217547 A1 Sep. 3, 2009

(30) Foreign Application Priority Data

Nov. 18, 2005 (KR) ..... 10-2005-0110997
Nov. 18, 2005 (KR) ..... 10-2005-0110998

(51) Int. Cl.
*F26B 3/34* (2006.01)
*D06F 58/20* (2006.01)
(Continued)

(52) U.S. Cl.
CPC ..... *D06F 58/203* (2013.01); *D06F 25/00* (2013.01); *D06F 58/28* (2013.01)

(58) Field of Classification Search
USPC ..... 34/275, 276, 277, 278, 82, 595; 239/88, 239/360; 417/235
See application file for complete search history.

(56) References Cited

U.S. PATENT DOCUMENTS 1,690,024 A * 10/1928 Lewis ..... 34/126
1,756,821 A * 4/1930 Groen ..... 34/60
(Continued)

FOREIGN PATENT DOCUMENTS

CN 2560660 Y 7/2003
EP 1602774 A1 12/2005
(Continued)

OTHER PUBLICATIONS

English Translation of Abstract of Fumiyoshi et al., JP 2000-157781A, Jun. 2000.*
(Continued)

*Primary Examiner* — Kenneth Rinehart
*Assistant Examiner* — John McCormack
(74) *Attorney, Agent, or Firm* — Birch, Stewart, Kolasch & Birch, LLP

(57) ABSTRACT

The present invention discloses a sterilizable drying machine using ultraviolet radiation, and a sterilizable drying method in the same. The sterilizable drying machine using ultraviolet radiation includes a casing having an inlet at its front surface, so that the user can put the washed laundry into the drying machine through the inlet, a drum supported by a front supporter inside the inlet of the casing, and rotatably installed inside the casing, to perform drying, an ultraviolet light source installed at the front supporter, for sterilizing the inside of the drum by radiating ultraviolet rays, and a control means connected to the ultraviolet light source, for controlling the ultraviolet light source to generate the ultraviolet rays.

13 Claims, 2 Drawing Sheets

(51) Int. Cl.

| | |
|---|---|
| ***D06F 25/00*** | (2006.01) |
| ***D06F 58/28*** | (2006.01) |

(56) References Cited

U.S. PATENT DOCUMENTS

| | | | | |
|---|---|---|---|---|
| 1,968,072 | A * | 7/1934 | Creighton | 362/101 |
| 2,137,376 | A * | 11/1938 | Altorfer | 34/60 |
| 2,248,618 | A * | 7/1941 | Fischer | 250/437 |
| 2,827,276 | A * | 3/1958 | Racheter | 432/62 |
| 3,286,359 | A * | 11/1966 | Orr et al. | 34/380 |
| 3,394,465 | A * | 7/1968 | Janke | 34/527 |
| 3,398,461 | A * | 8/1968 | Janke | 34/532 |
| 3,571,945 | A * | 3/1971 | Elders | 34/563 |
| 3,877,152 | A * | 4/1975 | Gorman | 34/524 |
| 3,972,130 | A * | 8/1976 | Mason | 34/527 |
| 4,182,050 | A * | 1/1980 | Righi | 34/60 |
| 5,555,645 | A * | 9/1996 | Joslin | 34/499 |
| 5,664,340 | A | 9/1997 | Brown | |
| 6,088,932 | A * | 7/2000 | Adamski et al. | 34/274 |
| 6,223,452 | B1 * | 5/2001 | Hamand | 34/267 |
| 6,877,248 | B1 | 4/2005 | Cross et al. | |
| 2002/0168287 | A1 * | 11/2002 | Eckhardt et al. | 422/24 |
| 2003/0019253 | A1 * | 1/2003 | Lorenz et al. | 68/13 R |
| 2005/0092035 | A1 * | 5/2005 | Shin et al. | 68/275 |
| 2005/0166644 | A1 * | 8/2005 | Gerald France et al. | 68/12.04 |
| 2005/0262883 | A1 * | 12/2005 | Yang et al. | 68/12.01 |
| 2005/0265890 | A1 * | 12/2005 | Yang et al. | 422/5 |
| 2007/0113421 | A1 * | 5/2007 | Uhara et al. | 34/275 |
| 2009/0000040 | A1 * | 1/2009 | Ikemizu | 8/158 |
| 2009/0064422 | A1 * | 3/2009 | Kim et al. | 8/137 |
| 2009/0071032 | A1 * | 3/2009 | Kreutzfeldt et al. | 34/389 |
| 2009/0255146 | A1 * | 10/2009 | Klug et al. | 34/491 |
| 2009/0282695 | A1 * | 11/2009 | Kreutzfeldt et al. | 34/443 |

FOREIGN PATENT DOCUMENTS

| | | | | |
|---|---|---|---|---|
| EP | 1696071 | A1 | 8/2006 | |
| JP | 02057300 | A * | 2/1990 | D06F 58/02 |
| JP | 2000-157781 | A * | 6/2000 | D06F 37/04 |
| JP | 2005-168687 | A | 6/2005 | |
| JP | 2005-253786 | A | 9/2005 | |

OTHER PUBLICATIONS

English Translation of Disclosure of Fumiyoshi et al., JP 2000-157781A, Jun. 2000.*

* cited by examiner

STERILIZABLE DRYING MACHINE USING ULTRAVIOLET RADIATION AND STERILIZABLE DRYING METHOD IN THE SAME

TECHNICAL FIELD

The present invention relates to a sterilizable drying machine using ultraviolet radiation and a sterilizable drying method in the same, and more particularly, to a sterilizable drying machine using ultraviolet radiation which can perform sterilization by radiating ultraviolet rays into a drum, and a sterilizable drying method in the same.

BACKGROUND ART

In general, a drum for containing the washed laundry is rotatably installed in a casing of a drying machine. The drying machine dries the laundry by supplying hot air into the drum, and externally discharging wet air, or condensing and discharging moisture of the wet air.

The washed laundry is put into the drum. Since the laundry is washed in a washing machine by using tap water and detergent, calcium of the tap water and a surface active agent of the detergent react with each other and generate insoluble metal soap.

The metal soap remaining in the laundry sticks to fiber remnants or dirties separated from the laundry and absorbs moisture from them, thereby propagating microorganisms. The metal soap may generate floccules causing rot, and may also generate molds causing bad smell. In addition, various germs existing in the air such as *Staphyllooccus aureus, Bacillus cereus* and Atypical *mycobacterium* are easily adhered to clothes When many germs remain in the clothes, and if the clothes are not sufficiently dried, the remaining germs propagate themselves, generate unpleasant smell and discolor the clothes.

If sick persons, babies or children having weak immunity wear the clothes in which the germs remain, they may have health problems like a skin disease.

DISCLOSURE OF INVENTION

Technical Problem

An object of the present invention is to provide a sterilizable drying machine using ultraviolet radiation which can perform sterilization by radiating ultraviolet rays to the laundry inside a drum under predetermined conditions during drying, and a sterilizable drying method in the same.

Technical Solution

There is provided a sterilizable drying machine using ultraviolet radiation, comprising: a casing having an inlet at its front surface, so that the user can put the washed laundry into the drying machine through the inlet; a drum supported by a front supporter inside the inlet of the casing, and rotatably installed inside the casing, to perform drying; an ultraviolet light source installed at the front supporter, for sterilizing the inside of the drum by radiating ultraviolet rays; and a control means connected to the ultraviolet light source, for controlling the ultraviolet light source to generate the ultraviolet rays.

According to another aspect of the present invention, there is provided a sterilizable drying machine using ultraviolet radiation, comprising: a casing having an inlet at its front surface, so that the user can put the washed laundry into the drying machine through the inlet; a drum supported by a front supporter inside the inlet of the casing, and rotatably installed inside the casing, to perform drying; a filter assembly installed at the front supporter, for removing alien substances contained in wet air; and an ultraviolet light source installed at the filter assembly, for sterilizing the inside of the drum by radiating ultraviolet rays.

According to yet another aspect of the present invention, there is provided a sterilizable drying method using ultraviolet radiation, comprising: a drying step for supplying hot air into a drum containing the washed laundry, and discharging wet air from the drum at the same time; and a sterilization step selectively set before/after finishing the drying step, to perform sterilization by radiating ultraviolet rays into the drum for a set time.

In another aspect of the present invention, in the sterilization step, while the ultraviolet rays are radiated, the drum is rotated below a set speed to evenly shake up the laundry.

In another aspect of the present invention, in the sterilization step, while the ultraviolet rays are radiated, the drum is alternately reversed clockwise and counter-clockwise.

In another aspect of the present invention, in the drying step, when a water content is below a set value, the ultraviolet rays are radiated.

In another aspect of the present invention, in the sterilization step, while a door is opened from the drum, the ultraviolet rays are not radiated.

In another aspect of the present invention, the sterilizable drying method further includes a keeping step for periodically radiating the ultraviolet rays at intervals of a set time, when the laundry is not taken out of the drum for a predetermined time after the sterilization step.

BRIEF DESCRIPTION OF THE DRAWINGS

The present invention will become better understood with reference to the accompanying drawings which are given only by way of illustration and thus are not limitative of the present invention, wherein.

MODE FOR THE INVENTION

A sterilizable drying machine using ultraviolet radiation and a sterilizable drying method in the same in accordance with the present invention will now be described in detail with reference to the accompanying drawings.

Figure 1:
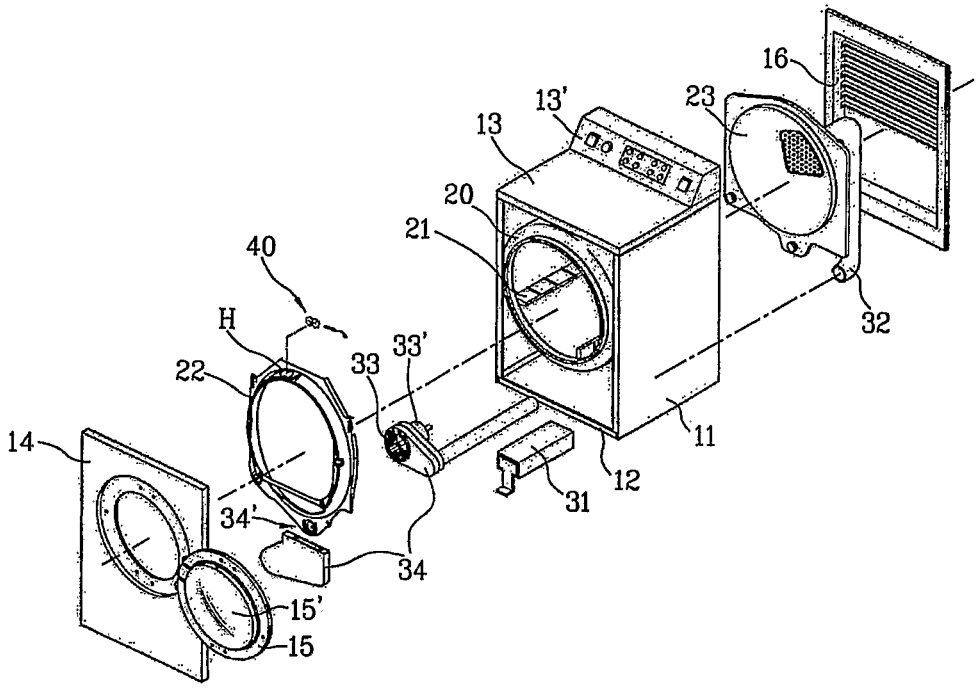
FIG. 1 is a disassembly perspective view illustrating a drying machine in accordance with an embodiment of the present invention.
Figure 2:
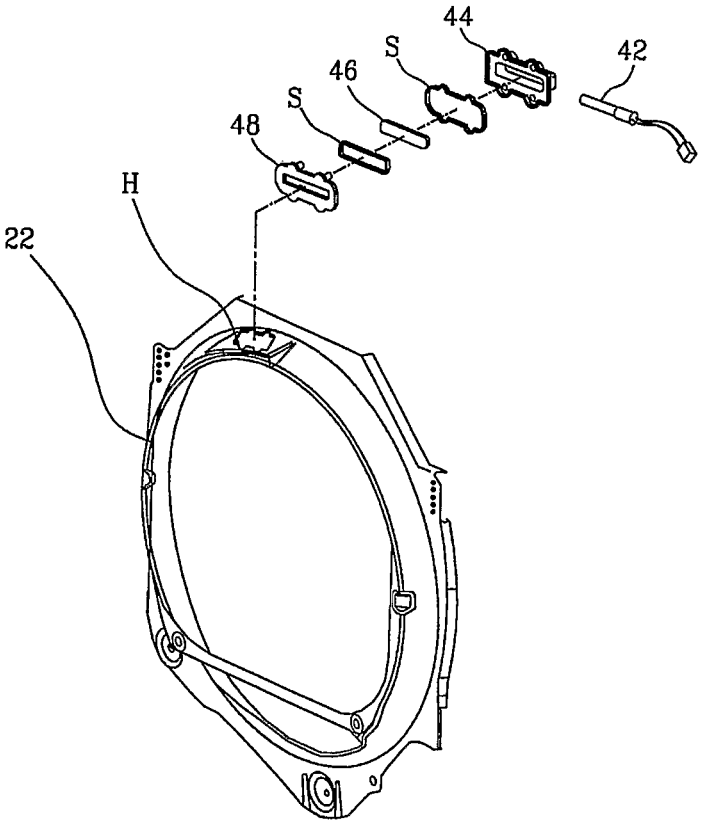
FIG. 2 is a disassembly perspective view illustrating one example of an ultraviolet light source in accordance with the present invention.

FIG. 1 is a disassembly perspective view illustrating the drying machine in accordance with an embodiment of the present invention, and FIG. 2 is a disassembly perspective view illustrating one example of an ultraviolet light source in accordance with the present invention.

Referring to FIGS. 1 and 2, the drying machine comprises a casing for forming the external appearance, a drying unit installed inside the casing, a piping unit for supplying hot air to the drying unit and discharging wet air from the drying unit, an ultraviolet lamp assembly 40 to perform sterilization by radiating ultraviolet rays into the drying unit, and a control means for controlling the operations of various components.

Here, the casing includes a center cabinet 11 for forming a body of the machine, a base cover 12 installed at the lower portion of the center cabinet 11, a top cover 13 being installed at the upper portion of the center cabinet 11 and having an operation unit 13', a control means (not shown) electronically coupled with the operation unit, a front frame 14 being installed at the front surface of the center cabinet 11 and having a door frame 15 at its inlet side, and a rear frame 16 installed at the rear portion of the center cabinet 11.

A door glass 15' is installed at the door frame 15, so that the user can check the state of the drying unit. Preferably, when the ultraviolet lamp assembly 40 generates the ultraviolet rays, the door class 15' does not externally leak the ultraviolet rays.

Normally, most of the materials do not transmit ultraviolet rays. Specific materials transmit a specific wavelength of ultraviolet rays. The transmission degree is dependent upon thickness and properties of the materials. Accordingly, the door glass 15' is preferably formed with specific thickness by using a material which does not transmit the ultraviolet rays, such as plastic.

An opening/closing sensor (not shown) is installed between the inlet side of the front frame 14 and the door frame 15. When the opening/closing sensor senses opening of the door frame 15, the control means intercepts generation of the ultraviolet rays by the ultraviolet lamp assembly 40, thereby preventing external leakage of the ultraviolet trays.

On the other hand, the operation unit 13' is connected to the control means, for enabling the user to select detailed items of a drying course, additionally select a sterilization course, and input the control signals to the control means.

The drying unit includes a drum 20 rotatably installed inside the center cabinet 11 and having a lifter 21 inside for lifting up the laundry, a front supporter 22 installed between the front frame 14 and the drum 20 for supporting the front portion of the drum 20, and a rear supporter 23 installed between the rear frame 16 and the drum 20 for supporting the rear portion of the drum 20.

Preferably, the drum 20 is made of stainless steel to reflect the ultraviolet rays. Therefore, when the ultraviolet lamp assembly 40 radiates the ultraviolet rays into the drum 20 as well as the laundry, the ultraviolet rays can be reflected to every part in the drum 20.

The drum 20 is connected to a driving motor (not shown) installed at its rear portion through a motor shaft, and rotated by rotation force from the driving motor. The control means controls the driving motor so that the drum 20 can be slowly rotated at a speed having centrifugal force below 1 G (1 gravity; if the centrifugal force is over 1 G, the laundry is rotated, sticking to the drum). The lifter 21 lifts up and drops the laundry, for evenly drying the laundry. In addition, the drum 20 is reversed clockwise and counterclockwise, for evenly shaking up and sterilizing the laundry.

Especially, although the front and rear ends of the drum 20 are supported by the front supporter 22 and the rear supporter 23, the drum 20 is rotatably installed. A settling hole H is formed at the upper portion of the front supporter 22, so that the ultraviolet lamp assembly 40 can be mounted therein.

Because a diameter of the drum 20 is larger than a diameter of the inlet side of the front frame 14, the front supporter 22 is formed in an inclined ring shape. When the ultraviolet lamp assembly 40 is mounted in the settling groove H at the upper portion of the front supporter 22, the ultraviolet lamp assembly 40 automatically faces the drum 20, and radiates the ultraviolet rays into the drum 20.

When the front supporter 22 is formed in the inclined ring shape, the settling hole H can be formed in any part of the front supporter 22.

The piping unit includes a heater 31 for generating hot air, a hot air supply duct 32 installed at the rear supporter 23 for supplying the hot air generated by the heater 31 to the rear portion of the drum 20, an exhaust duct 34 installed at the front supporter 14 for externally discharging wet air from the machine, a fan 33 installed at one side of the exhaust duct 34 and driven by a motor 33', and a filter assembly 34' installed at the front supporter 14 and inserted into the exhaust duct 34.

The control means controls the operations of the heater 31 and the motor 33 for adjusting a temperature of hot air, supplying the hot air into the drum 20, adjusting a discharge speed of wet air, and externally discharging the wet air. A humidity sensor (not shown) is installed at the drum 20 or the adjacent position, so that the control means can control the operations of the heater 31 and the motor 33 in consideration of a water content.

The hot air generated by the heater 31 is supplied into the drum 20 through the hot air supply duct 32, for evaporating moisture contained in the laundry in the drum 20 and drying the laundry. When the fan 33 is driven, the generated wet air is externally discharged through the exhaust duct 34. Alien substances contained in the wet air are not caught by the fan 33 but filtered off by the filter assembly 34'. Therefore the breakdown can be prevented.

The ultraviolet lamp assembly 40 includes an ultraviolet lamp 42 for generating the ultraviolet rays according to a control signal from the control means, a housing main body 44 where the ultraviolet lamp 42 is settled, a transmitting plate 46 for transmitting the ultraviolet rays generated by the ultraviolet lamp 42, and a housing over 48 mounted at the front surface of the housing main body 44. The ultraviolet rays are evenly radiated into the drum 20 as well as the laundry, thereby sterilizing the drum 20 and the laundry together.

Generally, the transmitting plate 46 is made of a quartz plate which can transmit the ultraviolet rays, and thus fragile even by slight impact. To solve this problem, before the transmitting plate 46 is installed together with the ultraviolet lamp 42 between the housing main body 44 and the housing cover 48, a pair of sealing members S are coupled. The housing main body 44 has an open bottom surface to allow for the emission of the ultraviolet light from the ultraviolet lamp 42. Preferably, the sealing members S are made of rubber in a ring shape, and one sealing member S is coupled to the peripheral portions of the transmitting plate 46, and the other sealing member S is coupled to the peripheral portions of the housing cover 48.

On the other hand, a settling groove (not shown) is formed on the housing main body 44, so that the ultraviolet lamp 42 can be slidably inserted into the settling groove from the side portion. The housing over 48 is coupled to the housing main body 44. A transmitting hole (not shown) is formed at the center of the front surface of the housing cover 48, for transmitting the ultraviolet rays generated by the ultraviolet lamp 42. The periphery of the housing over 48 is screw-coupled to the periphery of the housing main body 44.

The ultraviolet lamp assembly 40 can be replaced by an ultraviolet light emitting diode which can obtain the same sterilization effects by radiating a specific wavelength of ultraviolet rays. The ultraviolet light emitting diode also receives power from the control means, and radiates the ultraviolet rays.

Since the ultraviolet lamp assembly 40 is adjacent to the door frame 15, the ultraviolet rays may be externally leaked. Accordingly, the door frame 15 and the door glass 15' are formed not to transmit the ultraviolet rays. And the control means controls the ultraviolet lamp assembly 40 not to radiate the ultraviolet rays, when the user opens the door frame 15 and the door glass 15'.

The control means receives the control signals from the operation unit 13 and controls the operations of the driving motor, the heater 31, the motor 33 and the ultraviolet lamp 42.

As described above, when the user selects the sterilization course, the control means controls the ultraviolet lamp 42 to radiate the ultraviolet rays during a drying step. Here, the control means reverses the drum 20 clockwise and counterclockwise at a speed having centrifugal force below 1 G by controlling the operation of the driving motor, thereby evenly radiating the ultraviolet rays into the laundry. When the user opens the door frame 15, the control means stops the operation of the ultraviolet lamp 42 not to externally leak the ultraviolet rays.

When a relative humidity is over a set value, the sterilization effects of the ultraviolet rays are reduced. The control means receives a water content from the humidity sensor. Preferably, when the water content is over the set value, the control means controls the ultraviolet lamp 42 not to radiate the ultraviolet rays.

In addition, when a velocity of the ambient air flow is over a set velocity, the sterilization effects of the ultraviolet rays are reduced. The drying machine includes the fan 33 for supplying hot air and discharging wet air in the drying step. When the fan 33 is operated, an air flow velocity is generated in the drum 20.

Accordingly, the sterilization effects are more improved when the control means controls the ultraviolet lamp 42 to radiate the ultraviolet rays after finishing the drying step than before finishing the drying step. Conversely, the whole operation time can be reduced when the control means controls the ultraviolet lamp 42 to radiate the ultraviolet rays before finishing the drying.

Futhermore, after the drying step and sterilization step, the control means decides whether the laundry has been taken out by opening of the door frame 15. If the user does not take the laundry out over a set time, the control means controls the ultraviolet lamp 42 to periodically radiate the ultraviolet rays at intervals of a set time, thereby continuously sterilizing the laundry.

The present inventors considered a wavelength of ultraviolet rays, a humidity inside the drying machine, and an air flow velocity inside the drum as factors influencing sterilization effects in sterilizing the laundry in the drying machine by ultraviolet radiation, and found out that the ultraviolet rays having a wavelength of 180 to 200 nm, the low humidity inside the drying machine (relative humidity below 60%), and the low air flow velocity inside the drum (below 2 m/sec) were advantageous in sterilization. It is thus preferable to form the above conditions in the drying machine for the ultraviolet radiation. Here, the wavelength of the ultraviolet rays can be adjusted by using the ultraviolet light source having the wavelength, and the air flow velocity inside the drum can be adjusted by controlling the rotation speed of the drum. Generally, a sensor for sensing a relative humidity is not installed in the drying machine. Therefore, when a predetermined humidity (for example, below 40%) is sensed by a sensor for sensing a humidity, the ultraviolet radiation can be carried out.

In addition, the transmitting plate 46 must be considered in using the ultraviolet lamp assembly 40. The transmitting plate 46 is installed to protect the ultraviolet lamp 42. Since most of materials (for example, plastic) do not transmit the ultraviolet rays, the transmitting plate 46 is made of an ultraviolet ray transmitting material such as quartz.

Figure 3:
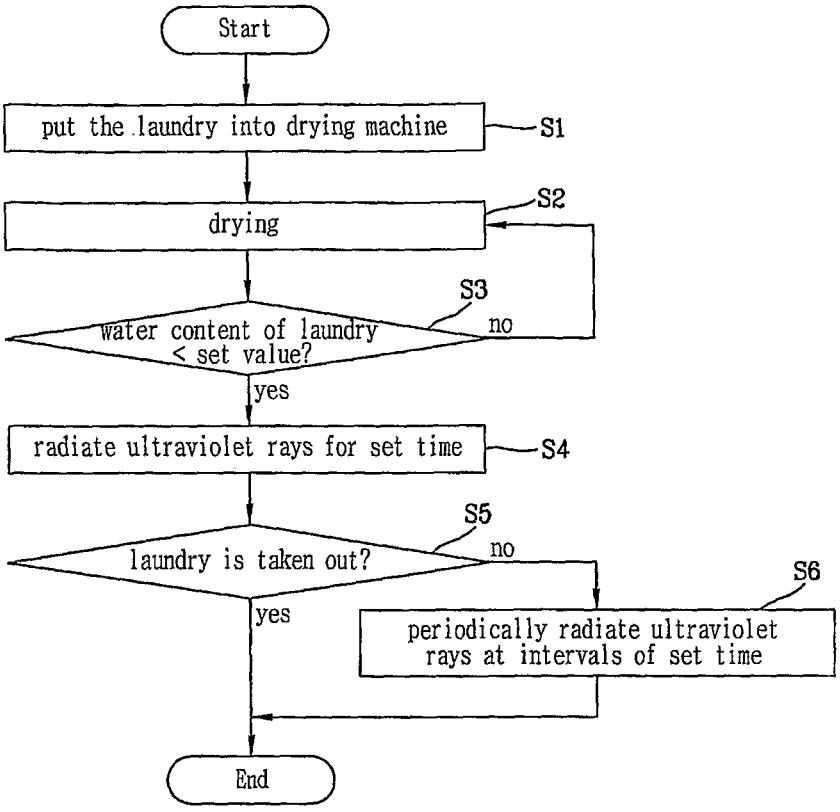
FIG. 3 is a flowchart showing sequential steps of a sterilization control method of the drying machine in accordance with an embodiment of the present invention.

FIG. 3 is a flowchart showing sequential steps of a sterilization control method of the drying machine in accordance with an embodiment of the present invention. The sterilization control method of the drying machine will now be described with reference to FIG. 3.

In a first process, the user puts the laundry into the drying machine and starts a drying step(refer to S1 and S2).

The user can put the dehydrated laundry into the drying machine through the inlet of the front frame, and selectively set detailed items of the drying course and the sterilization course through the operation unit. After the user sets the drying course including the sterilization course, the laundry is dried by a pre-inputted drying process.

In detail, the control unit operates the heater, so that hot air can be supplied into the drum through the hot air supply duct, for evaporating moisture contained in the laundry and drying the laundry. At the same time, the control means operates the driving motor to rotate the drum with one direction or reverse the drum clockwise and counterclockwise. As the drum is slowly rotated, the lifter repeatedly lifts up and drops the laundry, thereby evenly shaking up and drying the laundry.

The control means rotates the fan by operating the motor, so that wet air inside the drum can be externally discharged through the exhaust duct. Here, after alien substances are filtered off by the filter assembly, the wet air is externally discharged through the fan.

The moisture contained in the laundry is evaporated by repeatedly performing the above procedure. Accordingly, the water content is gradually reduced, and the laundry is dried.

In a second process, a sterilization step is performed before/after finishing the drying step of the first process, by radiating the ultraviolet rays for a set time in consideration of the water content (refer to S3 and S4).

When the air flow velocity inside the drum is over a predetermined value (for example, 2 m/sec) by the operation of the fan in the drying step, the sterilization effects of the ultraviolet rays are reduced. Therefore, the sterilization step is preferably performed after finishing the drying step. However, the drying step and the sterilization step can be performed at the same time to reduce the operation time.

The control means receives the water content from the humidity sensor, and compares the water content with a set value. When the water content is below the set value, the control means performs the drying step and the sterilization step at the same time. And when the water content is over the set value, the control means continuously performs the drying step without performing the sterilization step due to bad sterilization effects.

During the ultraviolet radiation, the control means evenly shakes up and sterilizes the laundry by slowly reversing the drum clockwise and counterclockwise at a speed having centrifugal force below 1 G.

During the sterilization step, when the opening/closing sensor senses opening of the door frame 15, the control means stops generation of the ultraviolet rays by the ultraviolet lamp directly after opening of the door frame, thereby preventing external leakage of the ultraviolet rays.

In a third process, if the user does not take the laundry out after the sterilization step of the second process, the ultraviolet rays are periodically radiated to the laundry at intervals of a set time (refer to S5 and S6).

After the drying step and the sterilization step, the control means decides whether the laundry has been taken out by the opening/closing sensor. If the user does not take the laundry out over the set time, the control means does not let the laundry as it is but sterilizes the laundry by periodically radiating the ultraviolet rays at intervals of the set time.

As discussed earlier, in accordance with the present invention, the sterilizable drying machine using ultraviolet radiation and the sterilizable drying method in the same perform sterilization, by mounting the ultraviolet light source at the front supporter installed between the inlet of the casing and the drum, or at the filter assembly, and radiating the ultraviolet rays generated by the ultraviolet light source to the laundry inside the drum. The ultraviolet light source is easily mounted to generate the specific wavelength of ultraviolet rays having excellent sterilization effects. Furthermore, the sterilizable drying machine using ultraviolet radiation and the sterilizable drying method in the same can maximize the sterilization effects on the laundry and the drum, by radiating the ultraviolet rays to the laundry and the drum in consideration of the water content.

The exhaust drying machine that supplies hot air and exhausts wet air at the same time has been exemplified above. Although the preferred embodiments of the present invention have been described, it is understood that the present invention should not be limited to these preferred embodiments but various changes and modifications can be made by one skilled in the art within the spirit and scope of the present invention as hereinafter claimed.

The invention claimed is:

1. A sterilizable drying machine using ultraviolet radiation, comprising:

a casing including a front frame at a front surface and having a door frame at an inlet so that washed laundry can be put into the drying machine through the inlet;

a drum rotatably installed inside the casing, to perform drying;

a front supporter installed between the front frame and the drum for supporting a front portion of the drum;

an ultraviolet light source installed at the front supporter, for sterilizing the inside of the drum by radiating ultraviolet rays; and a control means connected to the ultraviolet light source, for controlling the ultraviolet light source to generate the ultraviolet rays, wherein a diameter of the drum is larger than a diameter of the inlet of the front frame so that the front supporter is formed in a ring shape inclined inwardly to the inlet, and the ultraviolet light source is mounted in a settling groove at an upper portion of the front supporter, and wherein the control means is configured to control the ultraviolet light source to perform a sterilization step and to control a rotation speed of the drum so that air flow velocity inside the drum is below 2 m/s during the sterilization step and the laundry is evenly shaken.

2. The sterilizable drying machine of claim 1, wherein the ultraviolet light source is an ultraviolet lamp assembly.

3. The sterilizable drying machine of claim 2, wherein the ultraviolet lamp assembly includes an ultraviolet lamp for generating the ultraviolet rays, an ultraviolet lamp housing main body where the ultraviolet lamp is settled, a transmitting plate installed in the ultraviolet lamp housing main body, for transmitting the ultraviolet rays, and a housing cover mounted at the front surface of the housing main body and a pair of sealing members, and wherein one of the sealing members is coupled to the peripheral portions of the transmitting plate and an other of the sealing members is coupled to the peripheral portions of the housing cover.

4. The sterilizable drying machine of claim 3, wherein the transmitting plate is made of quartz.

5. The sterilizable drying machine of claim 1, wherein the ultraviolet light source is composed of an ultraviolet light emitting diode.

6. The sterilizable drying machine of claim 1, wherein the ultraviolet light source radiates the ultraviolet rays having a wavelength of 180 to 280 nm.

7. The sterilizable drying machine of claim 1, further comprising:

a piping unit for supplying hot air to the drum and discharging air from the drum, wherein the control means performs a drying step for supplying hot air into the drum containing the washed laundry, and discharging air from the drum, and wherein the control means further controls the ultraviolet light source to perform a sterilization step selectively set before or after finishing the drying step, for performing sterilization by radiating ultraviolet rays into the drum for a set time.

8. The sterilizable drying machine of claim 7, wherein, in the sterilization step, while the ultraviolet rays are radiated, the drum is alternately reversed clockwise and counterclockwise.

9. The sterilizable drying machine of claim 7, wherein, in the drying step, when a relative humidity inside the drum is below 60% or a humidity inside the drum is below 40%, the ultraviolet rays are radiated.

10. The sterilizable drying machine of claim 7, wherein, in the sterilization step, while a door is opened from the drum, the ultraviolet rays are not radiated.

11. The sterilizable drying machine of claim 7, wherein the control means further performs a keeping step for periodically radiating the ultraviolet rays at intervals of a set time, when the laundry is not taken out of the drum for a predetermined time after the sterilization step.

12. The sterilizable drying machine of claim 1, further comprising a rear supporter for supporting a rear portion of the drum.

13. The sterilizable drying machine of claim 1, wherein the ultraviolet light source has a housing with an open bottom surface for emitting the ultraviolet rays.

* * * * *